US006986221B2

(12) United States Patent
Mullis

(10) Patent No.: US 6,986,221 B2
(45) Date of Patent: Jan. 17, 2006

(54) METHOD OF USING CUSHION DEVICE DURING HUNTING

(76) Inventor: Frederick James Mullis, 915 Park St., Troy, AL (US) 36081

( * ) Notice: Subject to any disclaimer, the term of this patent is extended or adjusted under 35 U.S.C. 154(b) by 35 days.

(21) Appl. No.: 10/162,069

(22) Filed: Jun. 5, 2002

(65) Prior Publication Data

US 2002/0184692 A1 Dec. 12, 2002

Related U.S. Application Data

(60) Provisional application No. 60/296,133, filed on Jun. 7, 2001.

(51) Int. Cl.
*F41C 23/00* (2006.01)

(52) U.S. Cl. ..... 42/74

(58) Field of Classification Search ..... 42/71.01, 42/74, 76.02, 96, 94, 72, 73, 85, 90
See application file for complete search history.

(56) References Cited

U.S. PATENT DOCUMENTS

| | | | | | |
|---|---|---|---|---|---|
| 35,456 | A | * | 6/1862 | Leverich | 42/96 |
| 397,719 | A | * | 2/1889 | Heikes | 42/71.01 |
| 2,104,129 | A | * | 1/1938 | Kress | 42/71.01 |
| 2,364,340 | A | * | 12/1944 | Bogg | 42/106 |
| 2,510,953 | A | * | 6/1950 | Brose et al. | 248/102 |
| 2,554,199 | A | * | 5/1951 | Lewis | 150/154 |
| 2,932,334 | A | * | 4/1960 | Steen | 206/317 |
| 3,574,965 | A | * | 4/1971 | Seiger | 42/96 |
| 3,665,990 | A | * | 5/1972 | Hefner, Jr. | 42/74 |
| 4,105,220 | A | * | 8/1978 | Pacific | 280/304.4 |
| 4,247,115 | A | * | 1/1981 | Nikoden, Jr. | 273/317 |
| 4,380,093 | A | * | 4/1983 | Morgan | 16/421 |
| 4,433,500 | A | * | 2/1984 | Kunevicius | 42/96 |
| 4,580,483 | A | * | 4/1986 | Garbini | 89/40.06 |
| 4,754,498 | A | | 7/1988 | Stinemates | 2/17 |
| RE32,752 | E | * | 9/1988 | Kiang | 42/74 |
| 4,832,010 | A | * | 5/1989 | Lerman | 602/63 |
| 4,860,479 | A | * | 8/1989 | Easter | 42/96 |
| 4,922,642 | A | * | 5/1990 | Ohlhauser | 42/96 |
| 5,014,358 | A | * | 5/1991 | Matumori | 2/94 |
| 5,048,217 | A | * | 9/1991 | Easter | 42/96 |
| 5,265,366 | A | * | 11/1993 | Thompson | 42/74 |
| 5,332,185 | A | * | 7/1994 | Walker, III | 248/346.2 |
| 5,333,829 | A | * | 8/1994 | Bell et al. | 248/634 |
| 5,410,833 | A | * | 5/1995 | Paterson | 42/73 |
| 5,511,445 | A | * | 4/1996 | Hildebrandt | 74/558.5 |
| 5,669,168 | A | | 9/1997 | Perry | 42/74 |
| 5,678,344 | A | * | 10/1997 | Jones et al. | 42/96 |
| 5,833,308 | A | * | 11/1998 | Strong et al. | 297/172 |
| 5,850,706 | A | * | 12/1998 | Evans | 42/96 |
| 5,871,269 | A | * | 2/1999 | Chien | 362/474 |
| 5,964,435 | A | * | 10/1999 | Peltier | 248/166 |
| 6,206,261 | B1 | * | 3/2001 | McCrary | 224/562 |
| 6,516,550 | B1 | * | 2/2003 | Schnyder et al. | 42/96 |
| 6,517,133 | B2 | * | 2/2003 | Seegmiller et al. | 294/139 |

* cited by examiner

*Primary Examiner*—Francis T. Palo
(74) *Attorney, Agent, or Firm*—Clark & Brody

(57) ABSTRACT

A gun forearm cushion device has a generally cylindrical configuration that is both expandable and resilient. The device surrounds and cushions a gun forearm when contacting hard surfaces such as windowsills or items found in hunting structures. The device also includes camouflage material on an exterior part thereof. The device can use a number of different ways to surround the gun forearm, including elastic member(s), hook and loop fasteners, and the device as an expandable sleeve of material.

1 Claim, 3 Drawing Sheets

METHOD OF USING CUSHION DEVICE DURING HUNTING

This application claims priority under 35 USC 119(3) based on provisional patent application No. 60/296,133 filed on Jun. 7, 2001.

FIELD OF THE INVENTION

The present invention is directed to a gun forearm cushion and its method of use, and in particular, to a camouflage-covered resilient sleeve sized to slide over a gun barrel and around the gun forearm to muffle noise during hunting.

BACKGROUND ART

In the prior art, it is common for hunters to occupy shooting houses during hunting season. Generally, the houses are wooden, have one or more windows, and are sparsely furnished, if furnished at all. In cases where the houses are empty, noises made by the hunter in the house reverberate greatly and can be an impediment to successful hunting.

One particular noise problem occurs when a hunter lays his/her rifle on the windowsill of the window in the shooting house. If the hunter is not careful or is inexperienced, the gun forearm will bump against the windowsill and generate an obtrusive noise. In instances where the shooting house is bare inside, the noise reverberates in the house, and can distract game in the vicinity.

As such, a need exists to reduce noise during hunting, particularly when in the confines of an empty shooting house.

The prior art has proposed different solutions in connection with these types of problems. U.S. Pat. No. 5,332,185 Walker III discloses a gun rest made of sand bags designed to rest on a window jamb.

U.S. Pat. No. 5,964,435 to Peltier discloses a wall or window mounted gun support, including a cushioning material.

The problem with both of these devices is that they are cumbersome. Further, while Peltier may disclose a device having a cushioning material, Peltier provides other materials of construction that can generate noise. For example, the hunter could bump into the Peltier apparatus and generate noise, even though the gun forearm may not generate any noise.

Thus, there is still a need for improved devices for muffling sound in shooting houses. The present invention solves this need by providing a gun forearm cushion that easily slides over the gun barrel, is lightweight and inexpensive to manufacture, and does not provide another noise generating surface as in the Peltier apparatus.

SUMMARY OF THE INVENTION

It is a first object of the present invention to provide a gun forearm cushion.

Another object of the invention is to provide a method of reducing noise generation in a shooting house.

One other object is a cushion device that has a foam or resilient material body that has an outer camouflage surface thereon and means to facilitate sliding of the body onto a gun forearm and maintaining the device in place once properly positioned.

Other objects and advantages of the present invention will become apparent as a description thereof proceeds.

In one aspect, the invention is an improvement in hunting methods wherein a gun is disposed on a windowsill in a shooting house. According to this aspect of the invention, a generally cylindrical cushion device is slid over a gun barrel and the cushion device is positioned on the gun forearm to reduce noise generation from the gun forearm striking the windowsill. The cushion device comprises a resilient body with camouflage on at least on outer surface thereof, and means for securing the body around the gun forearm. The securing means, in one mode, further comprises a band of elastic running along a length of the cylindrical cushion device and interconnecting opposing longitudinal ends of the resilient body. The securing means can also be fasteners, such as hook and loop fasteners connecting the opposing ends of the resilient body. In another mode, the cushion device can be an expandable sleeve made of a resilient material and a camouflage material surrounding the resilient material. The camouflage material can be either on the outer surface of the resilient material or be a separate and expandable material surrounding the resilient material.

The invention also entails the combination of a gun and the cushion device, wherein the cushion device is expandable to slide over a barrel of the gun and to be positioned around the gun forearm. This combination reduces noise generation from the gun forearm striking a supporting surface such as a windowsill in a shooting house.

The invention also includes the cushion device itself as it is sized to slip over a gun barrel and surround a gun forearm.

BRIEF DESCRIPTION OF THE DRAWINGS

Reference is now made to the drawings of the invention wherein.

DESCRIPTION OF THE PREFERRED EMBODIMENTS

The present invention enhances the ability of successful hunting when using a hunting structure that involves resting a gun forearm on a part of the structure. In these situations, the gun forearm can accidentally bump against the supporting structure, thereby generating noise and scaring game away. This problem is particularly prevalent in shooting houses, which are often times empty and susceptible to reverberation when noise is made.

The present invention helps alleviate such noises by providing a cushion around the gun forearm, so that when the forearm is rested against a hard surface such as the windowsill of a shooting house, impact is minimal and no or little noise is generated.

The inventive cushion device is lightweight so that it can be easily carried by hunters, installs and is removed in seconds, and is easily-manufactured and therefore low in purchase cost.

Figure 1:
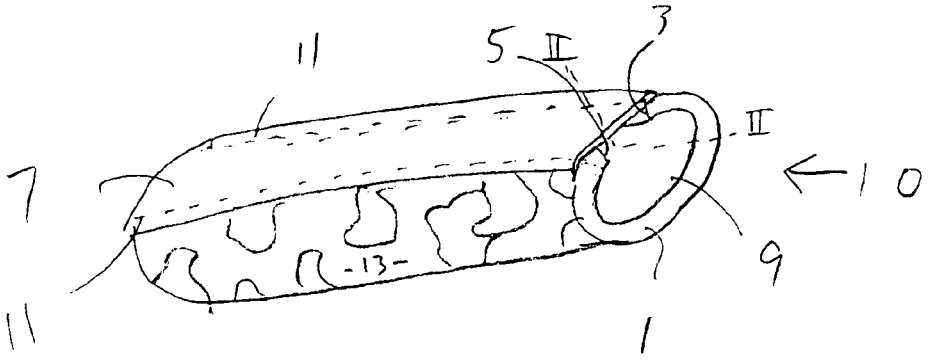
FIG. 1 shows a perspective view of one embodiment of the invention.

One embodiment of the inventive cushion device is designated by reference numeral 10 in FIG. 1. The device 10 is generally cylindrical in shape and has a body 1 made of a foam rubber, or other resilient material such as a polyurethane foam. In fact, any resilient material that would be capable of absorbing the impact of the gun forearm on a supporting structure can be utilized as the body material. If a foam material is used, the density of the foam could vary as long as the foam provides sufficient cushion to absorb impact and deaden noise generation. Non-foam but compressible materials such as rubber are also within the scope of the invention.

Still referring to the FIG. 1 embodiment, the body 1 has opposing ends 3 and 5 that are interconnected with an elastic material 7. The elastic material 7 allows the opening 9 to be enlarged via stretching of the material 7 so that the opening can be expanded and the device 10 can be slid over a gun barrel as described below. Any elastic material is suitable for use in the device including conventional elastic bands, or other stretchable materials such a polymers and the like.

The elastic 7 can be sewn into the resilient body as represented by the stitching 11. However, other ways of securing the elastic material to the ends of the resilient material can also be employed, e.g., adhesives, combinations of sewing and adhesives, hook and loop fasteners, other types of fasteners such as staples, or other like means. While one strip of elastic is shown, a number of strips could be used if desired.

Figure 2:
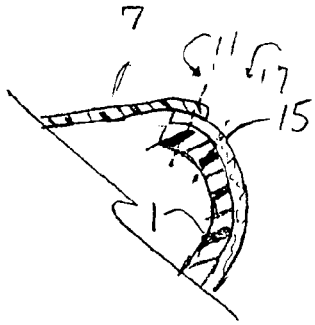
FIG. 2 is a partial cross section view along the line II—II of FIG. 1.

The resilient body 1 can include camouflage as surface 13. The surface 13 can be an integral part of the resilient body 1, or can be a separate material 15 as shown in FIG. 2. This material 15 can be sown as shown by the lines 17 into the resilient body 1, can surround the body 1 and be sewn to itself, or can be secured to the resilient body in another conventional fashion. Other means of attaching or producing the camouflage effect on the device 10 can be employed as well, e.g., merely coating the resilient body 1, e.g., painting, stenciling, etc.

Figure 3:
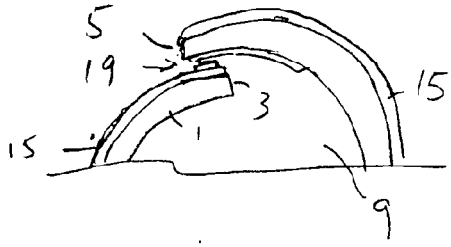
FIG. 3 is a partial side view of an alternative embodiment of the FIG. 1 device.

While an elastic band 7 is one preferred mode of providing flexibility in the cushion device to fit over different size guns, other means can be used to surround the gun forearm with the resilient body 1 that would keep the body 1 in place during gun use. Referring to FIG. 3, the opposing ends 3 and 5 of the resilient body 1 are interconnected with hook and loop fasteners 19. While this embodiment offers slightly more flexibility in adapting to differently-sized guns, the noise generated when the hook and loop fasteners are separated can possibly scare game. Instead of hook and loop fasteners, other attachment means could be employed, e.g., snaps, hooks, even magnets. In either of the FIG. 2 or 3 embodiments, the means should be such that the resilient body 1 is firmly wrapped around the gun forearm so that device does not easily shift along the gun length and noise generation is minimal if not non-existent.

Figure 4:
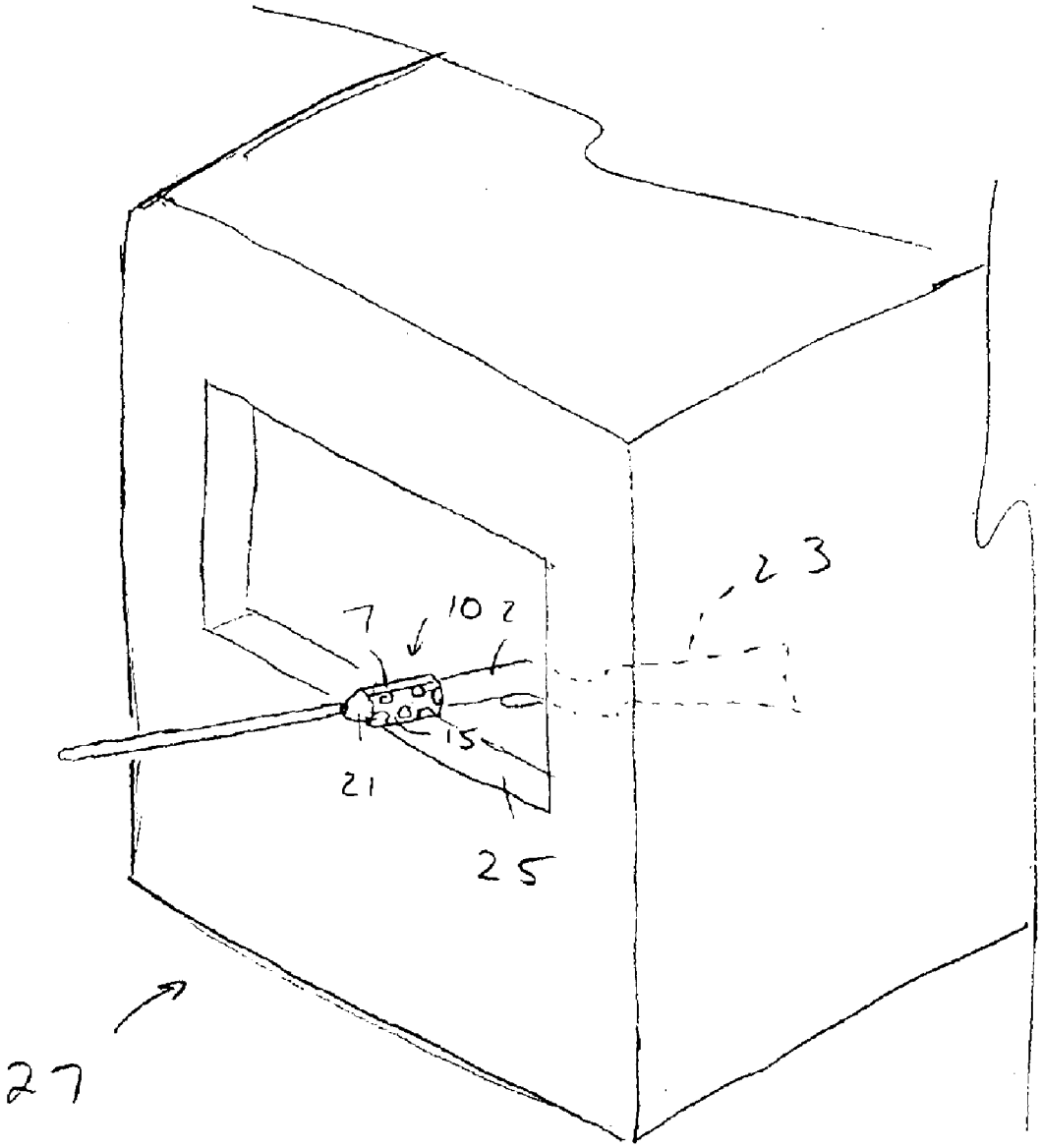
FIG. 4 shows an exemplary use in a shooting house.
Figure 6:
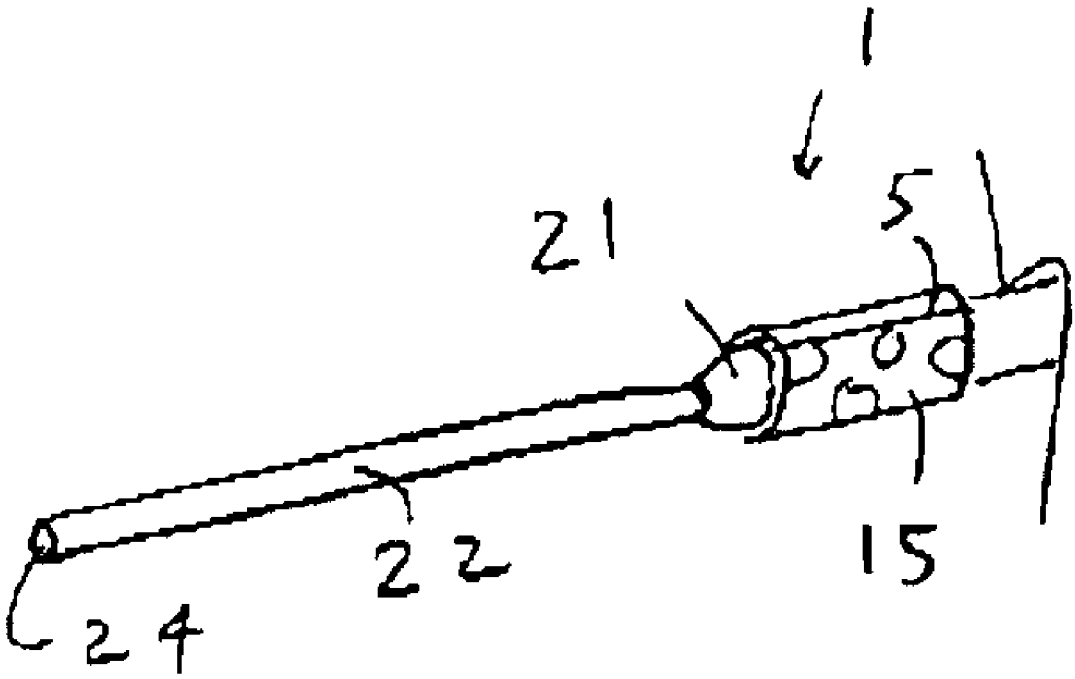
FIG. 6 is a perspective view of a portion of a gun using the embodiment of FIG. 3.

Similar to FIG. 4, FIG. 6 shows the embodiment of FIG. 3 around the gun forearm 21 of a gun. Also shown is the opposing end 5 that employs a portion (not shown) of the hook and loop fastener and a gun barrel 22 with open end 24.

In use and referring to FIG. 1 again, a hunter would slide a gun barrel into the opening 9 until the body 1 surrounds a gun forearm. The cushion device 10 can then be rested on the windowsill or other support of a shooting house. An exemplary configuration is shown in FIG. 4 (minus the hunter for clarity), with the device 10 surrounding the forearm 21 of the gun 23. The device 10 rests on the windowsill 25 of the shooting house 27.

In this way, if the gun 23 is raised and then lowered against the windowsill 25, the resilient body 1 compresses and cushions the impact, and noise generation from the forearm striking the windowsill is stifled. The reverberation effect prevalent in empty shooting houses is also avoided by eliminating the noise source. Thus, game in the area are not warned of the hunter's presence.

If so desired and in another variation, the camouflage could be made part of the elastic material 7 providing that no significant loss occurs in the stretchability of the elastic for fitting onto guns.

Given the expandability of the device 10, virtually any type of rifle or shotgun or other shooting implement could be used. Further, the device 10 could be made in different sizes as well, so that the opening 9 in the un-stretched condition could vary.

Figure 5:
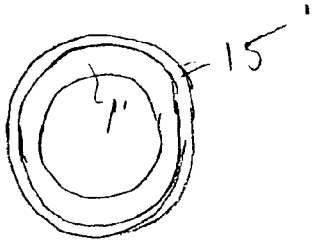
FIG. 5 is a side view of a second alternative embodiment of the FIG. 1 device.

In yet another embodiment as shown in FIG. 5, the body 1' could be a sleeve material that would be expandable yet resilient so that there would be no need for the elastic material 7 or fasteners as shown in FIG. 3. In the FIG. 5 embodiment, the camouflage material 15' could surround the entire outer surface of the body 1', but would also have to be expandable to stretch with the body 1'. To ease stretching, camouflage material could be made an integral part of the resilient body 1' as described above.

While different thicknesses for the resilient body can be employed preferred thicknesses ranges up to one to two inches thick. The thickness can vary depending on the compressibility of the resilient body, a more compressible material can have a greater thickness. The opening 9 should be sized to fit over a gun barrel but be sized generally smaller than the outer circumference of the gun forearm, so that when the device retracts around the gun forearm after being expanded to slide over the forearm, the device stays in place. In general, opening would not be large enough to fit around a person's exterior limb.

As such, an invention has been disclosed in terms of preferred embodiments thereof which fulfills each and every one of the objects of the present invention as set forth above and provides new and improved cushioning device for reducing or eliminating the sounds caused by gun forearms striking supporting structures.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A method of preparing for hunting comprising:

providing a gun having a gun forearm and a gun barrel extending from the gun forearm to an open barrel end;

providing a cushion device having first and second opposing edges, the cushion device further comprising:

a foam body having camouflage fabric surrounding the foam body; and a hook and loop fastener, the hook part of the fastener attached to the first edge with the loop part of the fastener attached to the second edge, the cushion device sized to leave a portion of the gun forearm between the cushion device and the open barrel end exposed; and positioning the cushion device on the gun forearm and linking the hook and loop parts together, the positioning step exposing the portion of the gun forearm between the cushioned device and open barrel end, the cushion device reducing noise generation when the cushion device strikes a hard surface during hunting.

* * * * *